US007503294B2

(12) United States Patent
Ogawa et al.

(10) Patent No.: US 7,503,294 B2
(45) Date of Patent: Mar. 17, 2009

(54) APPARATUS FOR CONTROLLING VALVE OPENING/CLOSING TIMING

(75) Inventors: Kazumi Ogawa, Toyota (JP); Atsushi Sato, Toyota (JP)

(73) Assignee: Aisin Seiki Kabushiki Kaisha, Aichi (JP)

( * ) Notice: Subject to any disclaimer, the term of this patent is extended or adjusted under 35 U.S.C. 154(b) by 272 days.

(21) Appl. No.: 10/580,049

(22) PCT Filed: Dec. 20, 2004

(86) PCT No.: PCT/JP2004/019025

§ 371 (c)(1),
(2), (4) Date: May 19, 2006

(87) PCT Pub. No.: WO2005/061859

PCT Pub. Date: Jul. 7, 2005

(65) Prior Publication Data

US 2007/0095199 A1 May 3, 2007

(30) Foreign Application Priority Data

Dec. 22, 2003 (JP) ..... 2003-424797

(51) Int. Cl.
*F01L 1/34* (2006.01)

(52) U.S. Cl. ..... 123/90.16; 123/90.17; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 5,870,983 A 2/1999 Sato et al.
6,039,016 A 3/2000 Noguchi (Continued)

FOREIGN PATENT DOCUMENTS

DE 198 49 959 A1 10/1998

(Continued)

OTHER PUBLICATIONS

International Search Report dated Mar. 15, 2005.

(Continued)

*Primary Examiner*—Ching Chang
(74) *Attorney, Agent, or Firm*—Reed Smith LLP; Juan Carlos A. Marquez, Esq.

(57) ABSTRACT

A valve opening/closing timing controlling apparatus includes a housing member 3 rotatable together with a timing gear 110 (drive member), a rotor member 2 rotatably assembled with the housing member 3, a vane 70 portion of the rotor member forming, within the housing member 3, a phase-advanced oil chamber R1 and a phase-lagged oil chamber R2, the rotor member being rotatable together with a cam shaft 10, a torsion coil spring 55 for urging the rotor member 2 relative to the housing member 3 in a phase advancing direction, and a phase-advanced oil passage (hydraulic circuit) 65 or a phase-lagged oil passage (hydraulic circuit) 66 a hydraulic circuit for controlling feeding/discharging of work oil to or from the phase-advanced oil chamber R1 or the phase-lagged oil chamber R2. The torsion coil spring 55 has one end 55*a* thereof fixed to the housing member 3 and the other end 55*b* thereof fixed to a projection 28 provided on the rotor member 2.

3 Claims, 4 Drawing Sheets

U.S. PATENT DOCUMENTS

| | | | | |
|---|---|---|---|---|
| 6,276,321 | B1 | 8/2001 | Lichti et al. | |
| 6,405,695 | B2 * | 6/2002 | Mizutani et al. | 123/90.17 |
| 6,439,184 | B1 | 8/2002 | Takenaka et al. | |
| 6,532,922 | B2 | 3/2003 | Komazawa | |
| 6,758,178 | B2 * | 7/2004 | Takahashi et al. | 123/90.17 |
| 2001/0003974 | A1 | 6/2001 | Mizutani et al. | |
| 2002/0139330 | A1 | 10/2002 | Takahashi et al. | |
| 2002/0152977 | A1 | 10/2002 | Eguchi et al. | |

FOREIGN PATENT DOCUMENTS

| | | | |
|---|---|---|---|
| DE | 101 04 038 | A1 | 1/2001 |
| JP | 2-62062 | | 10/1988 |
| JP | 11-223113 | | 2/1998 |
| JP | 2001-82278 | | 9/1999 |
| JP | 2001-289013 | | 4/2000 |
| JP | 2002-161719 | | 11/2000 |
| JP | 2002-227621 | | 1/2001 |
| JP | 2002-250208 | | 2/2001 |
| JP | 2002-295210 | | 3/2001 |
| JP | 2002-295276 | | 3/2001 |
| JP | 2003-13716 | | 7/2001 |
| JP | 2003-120229 | | 10/2001 |
| JP | 2003/278512 | | 3/2002 |
| WO | WO 2005/061859 | A1 | 12/2004 |

OTHER PUBLICATIONS

Japanese Office Action dated Dec. 22, 2006 with Partial English translation.

Office Action from Chinese Patent Office dated Jan. 4, 2008 for Chinese Patent Application No. 2004800354265, in Chinese with English translation.

Supplementary European Search Report mailed May 30, 2008.

* cited by examiner

[Fig.1]
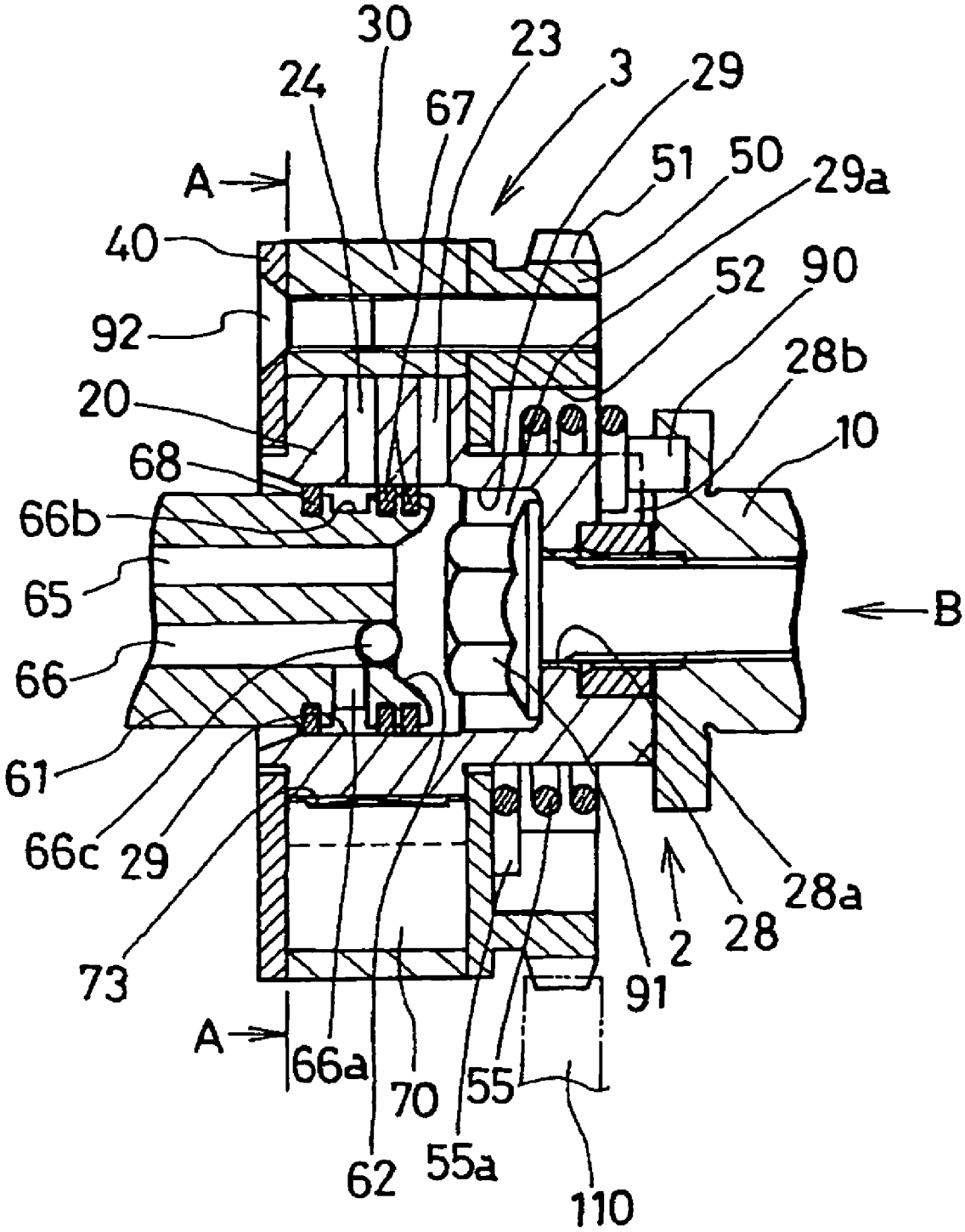

[Fig.2]
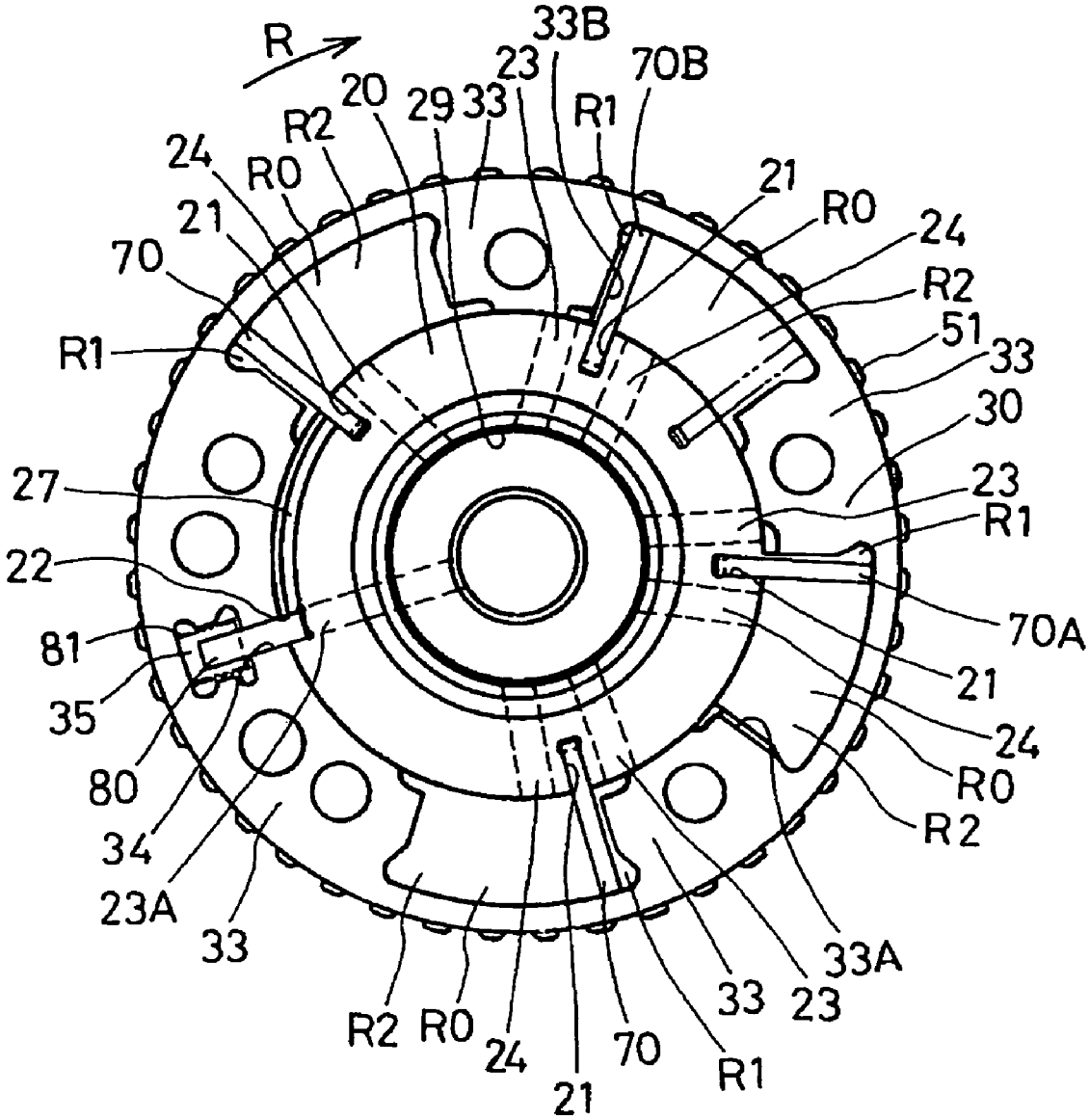

[Fig.3]
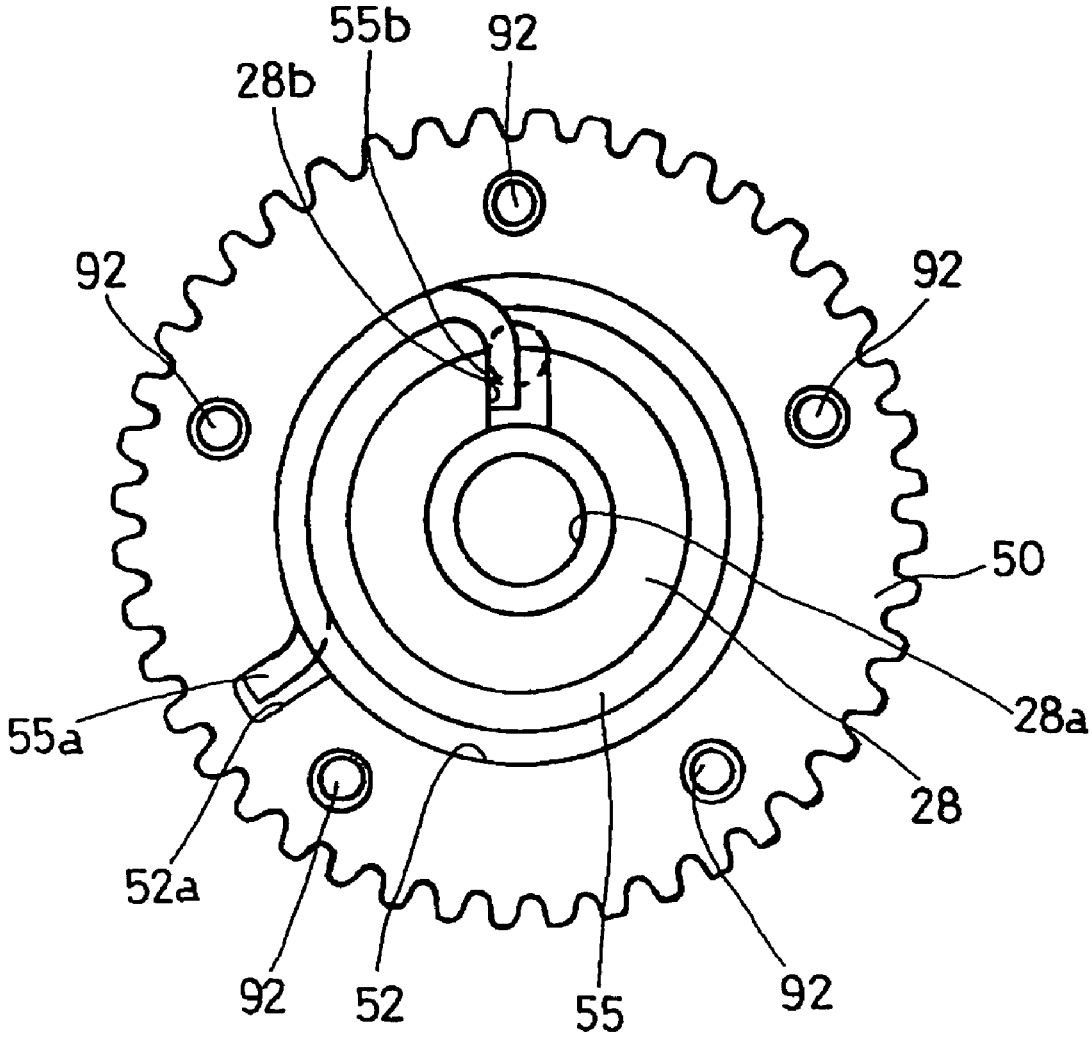

[Fig.4]
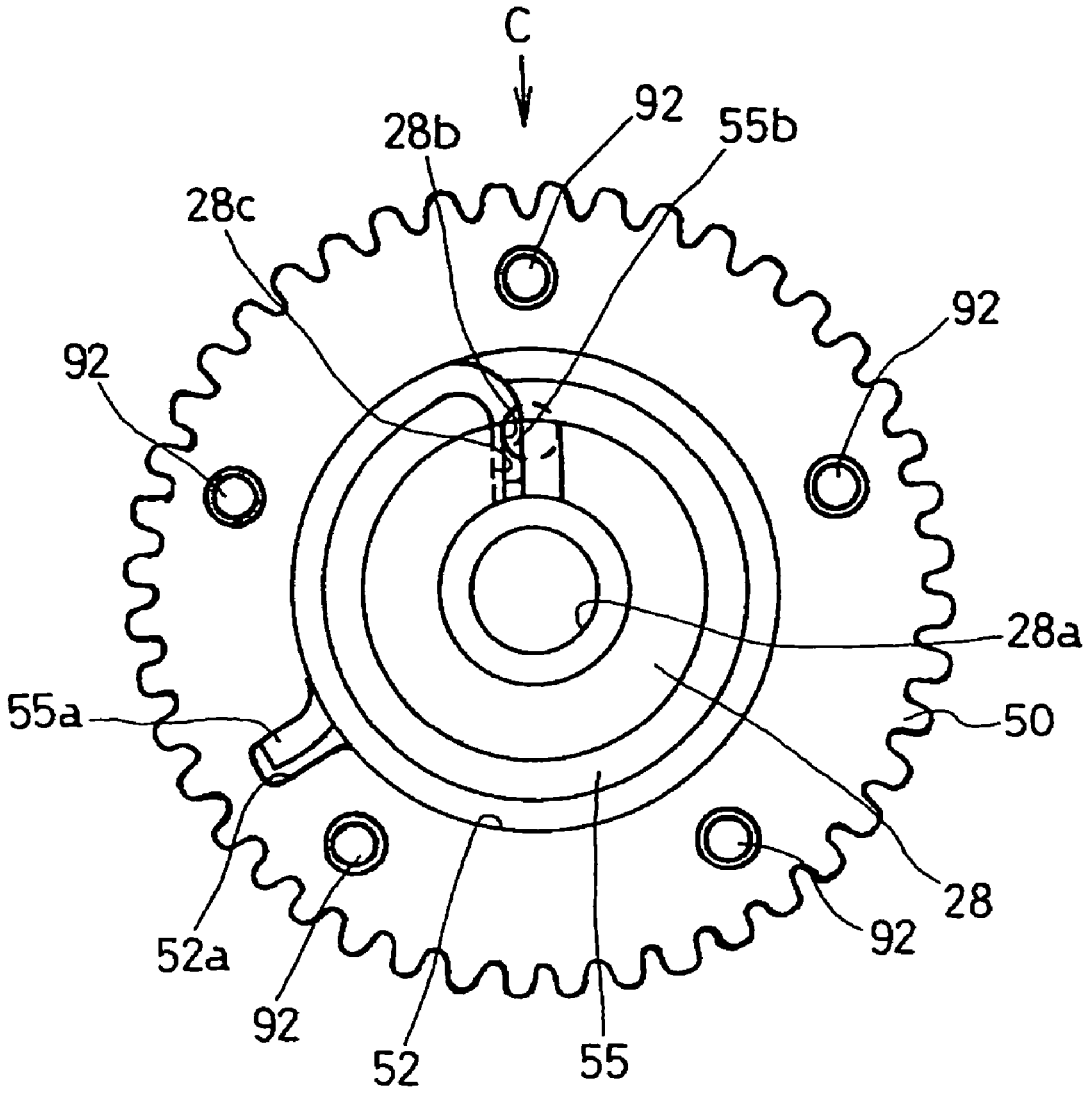
[Fig.5]
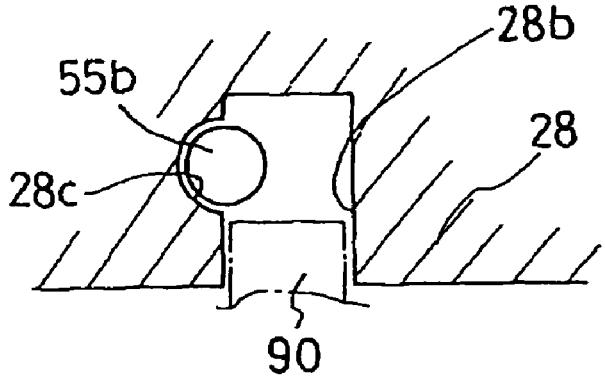

APPARATUS FOR CONTROLLING VALVE OPENING/CLOSING TIMING

TECHNICAL FIELD

The present invention relates to an apparatus for controlling opening/closing timings of intake/exhaust valves of an internal combustion engine.

BACKGROUND ART

In an apparatus for controlling opening/closing timings of intake/exhaust valves of an internal combustion engine, in order to improve responsiveness in phase conversion of a rotor member rotatable together with a cam shaft, relative to a housing member rotatable together with a drive member such as a crank shaft, there is known an apparatus having a torsion coil spring for urging the rotor member in a phase advancing direction relative to the housing member.

In this case, the torsion spring has one end thereof fixed to the housing member and the other end thereof fixed in a retaining groove defined in the cam shaft or the rotor member (see e.g. Patent Document 1).

Further, in an attempt to improve readiness of assembling of the valve opening/closing timing controlling apparatus to the engine, it has been contemplated to fix the torsion coil spring integrally to the apparatus to be handled together therewith, and it is conceivable to retain the other end of the torsion coil spring within the retaining groove formed in the rotor member. In this case, it is necessary to form the retaining groove deep enough to prevent inadvertent "spring-out" of the other end of the torsion coil spring from the retaining groove.

On the other hand, the end (the other end) of the torsion coil spring is moved in the direction of the depth of the retaining groove during an operation of the valve opening/closing timing controlling apparatus. Therefore, if the depth of the retaining groove is increased, this results in corresponding increase in the amount of movement, thus causing frictional wear, so that durability problem may arise.

Patent Document 1: Japanese Patent Application "Kokai" No. 11-223113

DISCLOSURE OF THE INVENTION

Object of Invention

In view of the above, in the valve opening/closing timing controlling apparatus, the object of the present invention is to allow easier and more reliable assembly of the torsion coil spring and also to improve the durability.

Solution by Invention

For accomplishing the above-noted object, according to a first characterizing feature of a valve opening/closing timing controlling apparatus relating to the present invention, the apparatus comprises:

a housing member rotatable together with a drive member for transmitting a drive force;

a rotor member rotatably assembled with the housing member, a vane portion of the rotor member forming, within said housing member, a phase-advanced oil chamber and a phase-lagged oil chamber, the rotor member being rotatable together with a cam shaft;

a torsion coil spring for urging the rotor member relative to the housing member in a phase advancing direction; and a hydraulic circuit for controlling feeding/discharging of work oil to or from said phase-advanced oil chamber or said phase-lagged oil chamber;

wherein said torsion coil spring has one end thereof fixed to said housing member and the other end thereof fixed to a projection provided on said rotor member.

With the above-described first characterizing feature, when the torsion coil spring is to be fixed to the valve opening/closing timing controlling apparatus, one end of this torsion coil spring is fixed to the housing member and the other end thereof is fixed to the projection provided on the rotor member.

With this construction, in particular, since the other end of the torsion coil spring is to be retained to the projection, the torsion coil spring can be fixed easily with facilitated retention of the spring. For this reason, the assembly of the torsion coil spring to the valve opening/closing timing controlling apparatus can be carried out easily and reliably.

Further, according to a second characterizing feature of the present invention, the other end of the torsion coil spring is retained in a retaining groove defined in said projection of the rotor member.

With the above-described second characterizing feature, as the other end of the torsion coil spring is retained in the retaining groove, the torsion coil spring can be fixed to the apparatus in even more reliable manner.

In the course of the above, the retaining operation of the other end of the torsion coil spring can effectively utilize the frictional force relative to the retaining groove. With these combined, the spring-out of the other end of the torsion coil spring from the retaining groove can be avoided reliably.

Therefore, the assembly of the torsion coil spring to the valve opening/closing timing controlling apparatus and the assembly of this apparatus to the engine or the like can be carried out easily and reliably.

Further, according to a third characterizing feature of the present invention, the other end of the torsion coil spring is clamped between the retaining groove provided in the rotor member and a positioning pin inserted in the retaining groove for positioning the rotor member relative to the cam shaft.

With the above-described third characterizing feature, as the other end of the torsion coil spring is clamped between the retaining groove and the positioning pin, it is possible to restrict displacement of the other end of the torsion coil spring along a depth direction of the retaining groove during an operation of the apparatus. As a result, frictional wear of the torsion spring or the rotor member and the housing member can be prevented.

Further, according to a fourth characterizing feature of the present invention, a valve opening/closing timing controlling apparatus comprises:

a housing member rotatable together with a drive member;

a rotor member rotatably assembled with the housing member, a vane portion of the rotor member forming, within said housing member, a phase-advanced oil chamber and a phase-lagged oil chamber, the rotor member being rotatable together with a cam shaft;

a torsion coil spring for urging the rotor member relative to the housing member in a phase advancing direction; and a hydraulic circuit for controlling feeding/discharging of work oil to or from said phase-advanced oil chamber or said phase-lagged oil chamber;

wherein said torsion coil spring has one end thereof fixed to said housing member and the other end thereof fixed to a recessed portion formed concave in a retaining groove formed in said rotor member.

With the above-described fourth characterizing feature, when the torsion coil spring is to be fixed to the valve opening/closing timing controlling apparatus, one end of this torsion coil spring is fixed to the housing member and the other end thereof is fixed to the recessed portion formed concave in the retaining groove formed in the rotor member. With this, displacement of the other end can be reliably prevented and the torsion coil spring can be fixed to the apparatus in a reliable manner.

Therefore, the inadvertent spring-out of the other end of the torsion coil spring from the retaining groove can be prevented reliably. Accordingly, the assembly of the torsion coil spring to the valve opening/closing timing controlling apparatus and the assembly of this apparatus to the engine or the like can be carried out easily and reliably.

Further, according to a fifth characterizing feature of the present invention, the other end of the torsion coil spring is clamped between the retaining groove and a positioning pin for positioning the rotor member relative to the cam shaft.

With the above-described fifth characterizing feature, as the other end of the torsion coil spring is clamped between the retaining groove and the positioning pin, it is possible to restrict displacement of the other end of the torsion coil spring along a depth direction of the retaining groove during an operation of the apparatus. As a result, frictional wear of the torsion spring or the rotor member and the housing member can be prevented.

Effect of the Invention

As described above, with the valve opening/closing timing controlling apparatus according to the present invention, there can be obtained a construction which allows easy and reliable assembly of the torsion coil spring and which improves the durability.

BEST MODE OF EMBODYING THE INVENTION

A valve opening/closing timing controlling apparatus shown in FIGS. 1 through 3 includes: a valve opening/closing rotor member 2 comprising a rotor 20 assembled integrally with a leading end of an intake cam shaft 10 rotatably supported to an unillustrated cylinder head of an internal combustion engine; a housing member 3 including a housing 30, a front plate 40, a rear plate 50 and a timing sprocket 51 provided integrally on the outer periphery of the rear plate 50; four vanes 70 assembled to the rotor 20; and a lock key 80 assembled to the housing 30.

The housing 30 is mounted outwardly on the outer periphery of the rotor 20 to be rotatable over a predetermined angular range relative thereto. Further, to opposed sides of the housing 30, there are connected the annular front plate 40 and the bottomed cylindrical rear plate 50 defining a recessed portion 52 at the center thereof, with the housing 30, the front plate 40 and the rear plate 50 being integrally connected to each other via five connecting bolts 92.

Incidentally, the timing sprocket 51 receives a rotational drive force clockwise in FIG. 2 via a timing gear 110 mounted on an unillustrated exhaust cam shaft (drive member).

In the inner periphery of the housing 30, there are formed four shoe portions 33 distributed along the peripheral direction. As inner peripheral faces of these shoe portions 33 are in contact with each other on the outer peripheral face of the rotor 20, the housing 30 is rotatably supported to the rotor 20. With this, between the front plate 40 and the rear plate 50 as viewed in the axial direction and between the housing 30 and the rotor 20 as viewed in the radial direction and between the adjacent shoe portions 33 as viewed in the peripheral direction, there are formed hydraulic chambers R0. Each hydraulic chamber R0 is sectioned into a phase-advanced chamber R1 and a phase-lagged chamber R2 by an associated vane 70.

Further, a chosen shoe portion defines a retraction groove 34 accommodating the lock key 80 and an accommodating groove 35 communicated with the retraction groove 34 and accommodating therein a spring 81 for urging the lock key 80 radially inward.

The relative rotation amount between the rotor 20 and the housing 30 depends on the peripheral width (extension angle) of the hydraulic chamber R0. On the most phase-advanced side, the relative rotation is restricted at the position where the vane 70A contacts one peripheral side of the shoe portion 33A. On the most phase-lagged side, the relative rotation is restricted at the position where the vane 70B contacts one peripheral side of the shoe portion 33B. On the phase-lagged side, the relative rotation between the rotor 20 and the housing 30 is restricted by the head of the lock key 80 entering a receiving groove 22 of the rotor 20.

Referring to the rotor 20, at one end thereof (right side in FIG. 1), there is integrally formed a projection 28 defining an axially extending hollow cylindrical portion 28*a* and at the other end thereof, there is formed a recessed portion 29.

Further, within a retaining groove 28*b* defined at an end of the projection 28, there is retained a positioning pin 90 fixed to an end face of the cam shaft 10 opposed to the retaining groove 28*b*, whereby the rotor 20 and the cam shaft 10 are positioned relative to each other and are fixed via the cylindrical portion 28*a* by a single attaching bolt 91.

Prior to the connection of the rotor 20 to the cam shaft 10, the positioning pin 90 is pressed into the cam shaft 10 along the axial direction (from the left side in FIG. 1) of the cam shaft 10, thus being fixed to the cam shaft 10.

Within the recessed portion 29, there is inserted a shaft portion 61 provided in an unillustrated cover member for covering the valve opening/closing timing controlling apparatus, the shaft portion 61 including a phase-advanced oil passage 65 and a phase-lagged oil passage 66.

Also, the rotor 20 includes four vane groove 21, a lock key receiving groove 22 and four phase-advanced passages 23 and four phase-lagged passages 24 extending along the radial direction.

To each vane groove 21, a vane 70 is attached to be movable in the radial direction. And, between the vane groove 21 and the vane 70, there is fitted a van spring 73, and a leading end of the vane 70 is placed in pressed contact with the inner peripheral face of the housing 30.

Into the receiving groove 22, the head of the lock key 80 will be engaged by a predetermined amount, upon realization of the condition illustrated in FIG. 2, namely, upon establishment of synchronization of the relative position between the rotor 20 and the housing 30 with a predetermined relative phase (the most phase-lagged position). Further, when the lock key 80 is received with the retraction groove 34, there is formed a passage 27 communicating between a phase-advanced passage 23A and the phase-advanced chamber R1, along the outer periphery of the rotor 20.

A torsion coil spring 55 is mounted between the rotor 20 assembled integral with the cam shaft 10 and the rear plate 50 assembled integral with the housing 30, more particularly, within a tubular space formed between the recessed portion 52 of the rear plate 50 and the projection 28 of the rotor 20.

One end 55*a* of the torsion coil spring 55 is retained in a retaining groove 52*a* defined open in the recessed portion 52 and the other end 55*b* thereof is retained in the retaining groove 28*b* of the rotor 20. Further, in this retaining groove

28*b*, there is retained also the positioning pin 90 as described hereinbefore. Therefore, with this positioning pin 90, it is possible to restrict displacement of the other end 55*b* of the torsion coil spring 55 along the depth direction of the retaining groove 28*b*, during an operation of the valve opening/closing timing controlling apparatus. As a result, it is possible to prevent frictional wear in the torsion coil spring 55 or in the rotor 20 and the housing 30.

This torsion coil spring 55 is provided, considering a force applied in the phase lagging direction to the rotor 20 during an operation of the internal combustion engine relative to e.g. the housing 30, due to variation occurring in the torque applied to the cam shaft 10. That is to say, this torsion coil spring 55 urges the rotor 20 in the phase advancing side relative to the housing 30, the front plate 40 and the rear plate 50, so as to improve responsiveness in phase conversion of the rotor 20 in the phase advancing side.

The shaft portion 61 includes, along the direction of its axis, the phase-advanced passage (hydraulic circuit) 65 and the phase-lagged oil passage (hydraulic circuit) 66. The phase-advanced passage 65 is open to an end 62 of the shaft portion 61 and communicated with a space 29*a* delimited by the end 62 and the recessed portion 29. The space 29*a* is communicated, via the phase-advanced oil passage 23, with the phase-advanced oil chamber R1.

Further, the phase-lagged passage 66 has its side adjacent the end 62 plugged by a plug member 66*c* ad is communicated, through an oil passage 66*a* formed radially in the shaft portion 61, with an oil groove 66*b* defined in the outer periphery of the shaft portion 61. At an opposing position of the recessed portion 29 of the rotor 20 opposed to the oil passage 66*b*, a phase-lagged oil passage 24 is open. Between the oil groove 66*b* and the space 29*a*, a seal member 67 is interposed for proving liquid-tight sealing therebetween. Further, between the oil groove 66*b* and the outside (atmosphere side), a seal member 68 is provided for proving liquid-tight sealing therebetween.

Each of the phase-advanced passage (hydraulic circuit) 65 and the phase-lagged passage (hydraulic circuit) 66 is connected to an unillustrated switch valve, which is a well-known switch valve operable to move a spool against a spring, upon power supply to a solenoid thereof.

Further, when no power is supplied to the switch valve, a feed portion connected to an oil pump driven by the internal combustion engine is communicated with the phase-lagged passage 66 whereas the phase-advanced passage 65 is communicated with a discharge port connected to a discharge tank.

On the other hand, when power is supplied to the switch valve, the feed port is communicated with the phase-advanced passage 65, whereas the discharge port is communicated with the phase-lagged passage 66. The switch valve, the oil pump etc. together constitute a hydraulic circuit.

Next, the operation of the above-described valve opening/closing timing controlling apparatus according to the first embodiment will be described.

In the operation of the valve opening/closing timing controlling apparatus according to the instant embodiment, upon establishment of the condition illustrated in FIG. 2, namely, when the head of the lock key 80 has been engaged by the predetermined amount into the receiving groove 22 of the rotor 20, thus providing a locked condition restricting the relative rotation between the rotor 20 and the housing 30 at the most phase-lagged position, the duty ratio for supplying power to the solenoid of the switch valve is increased and the spool position is switched over.

And, the working oil (oil pressure) fed from the oil pump is fed, through the feed port of the switch valve, the phase-advanced passage 65,the space 29*a* and the passage 23, to the phase-advanced chamber R1.

Also, the working oil (oil pressure) is fed also through the passage 23A to the receiving groove 22. On the other hand, the working oil (oil pressure) which has been present inside the phase-lagged oil chamber R2 is now discharged, through the passage 24, the oil groove 66*b*, the oil passage 66*a* and the phase-lagged passage 66, from the discharge port of the switch valve.

In the course of the above, the lock key 80 is moved against the spring 81, and its head is disengaged from the receiving groove 22, thus releasing the locked condition between the rotor 20 and the housing 30. With this, the rotor 20 rotatable together with the cam shaft 10 and each vane 70 are rotated in the phase advancing side (clockwise) R relative to the housing 30 and the plates 40, 50. This relative rotation can proceed from the most phase-lagged condition shown in FIG. 2 to a most phase-advanced condition (not shown).

When the lock key 30 has moved out of the receiving groove 22, in association with progressive decrease in the duty ratio for supplying power to the switch valve, the working oil can be fed into each phase-lagged oil chamber R2. Whereas, the working oil can be discharged from each phase-advanced oil chamber R1. Accordingly, from the position of the most phase-advanced condition to the position of the most phase-lagged condition shown in FIG. 2 in a stepless manner, the rotor 20 and each vane 70 can be rotated to the phase lagging side (counter-clockwise direction) relative to the housing 30 and the two plates 40, 50, etc.

Next, a second embodiment of the present invention will be described.

In this second embodiment, as shown in FIGS. 4 and 5, the other end 55*b* of the torsion coil spring 55 is retained in a recessed portion 28*c* formed concave in the retaining groove 28*b* formed in the rotor 20. The rest of the construction is identical to that of the first embodiment, therefore, same reference numerals are provided therein and explanation thereof will be omitted.

In order to cause the torsion coil spring 55 and the apparatus to be integrally fixed together, thus handled together, for the purpose of facilitated assembly of the valve opening/closing timing controlling apparatus to the cam shaft, the engine, etc., the other end 55*b* of the torsion coil spring 55 is retained in the retaining groove 28*b* defined in the rotor 20. In this, in order to prevent "spring-out" of the other end 55*b* of the torsion coil spring 55 from the retaining groove 28*b*, it is necessary to increase the depth of the retaining groove 28*b*. Further, the torsion coil spring 55 can be fixed to the apparatus, with the other end 55*b* of the torsion coil spring 55 being retained in the recessed portion 28*c*. With this, the assembly can be carried out easily and reliably.

Further, the other end 55*b* of the torsion coil spring 55 can be clamped between the retaining groove 28*b* and the positioning pin 90. That is, by clamping the other end 55*b* of the torsion coil spring 55 between the retaining groove 28*b* and the positioning pin 90, it is possible to restrict displacement of the other end 55*b* of the torsion coil spring 55 within the retaining groove 28*b* in the direction of its depth, during an operation of the apparatus. Therefore, frictional wear of the torsion coil spring can be prevented.

Next, a method for assembling the valve opening/closing timing controlling apparatus to the cam shaft 10 will be explained.

First, the one end 55*a* of the torsion coil spring 55 is retained in the retaining groove 52*a* of the recessed portion 52 of the rear plate 50 and the other end 55*b* is retained in the retaining groove 28*b* of the projection 28 of the rotor 20, thus assembling the torsion coil spring 55 to the valve opening/closing timing controlling apparatus.

Under the above condition, the retaining groove 28*b* and the positioning pin 90 are fixed in position relative to each other in the peripheral direction, to be engaged with each other. Under this condition, the other end 55*b* of the torsion coil spring 55 is clamped by the bottom face of the retaining groove 28*b* and the leading end of the positioning pin 90.

Then, the valve opening/closing timing controlling apparatus is fixed to the cam shaft 10 by the attaching bolt 91.

Incidentally, in the foregoing embodiments, the present invention is applied to the intake cam shaft. The invention is not limited thereto, but may be applied to an exhaust cam shaft also.

INDUSTRIAL APPLICABILITY

The valve opening/closing timing controlling apparatus can be used for e.g. controlling opening/closing timings of intake/exhaust valves of an internal combustion engine.

BRIEF DESCRIPTION OF THE DRAWINGS

[FIG. 1] a vertical section of a valve opening/closing timing controlling apparatus showing a first embodiment of the present invention,

[FIG. 2] a section taken along line A-A in FIG. 1,

[FIG. 3] a front view as seen along a direction of arrow B in FIG. 1,

[FIG. 4] a front view showing a valve opening/closing timing controlling apparatus showing a second embodiment of the present invention as seen from a direction of arrow B in FIG. 1,

[FIG. 5] side view as seen from a direction of arrow C in FIG. 4.

DESCRIPTION OF REFERENCE MARKS

2 rotor member
3 housing member
10 cam shaft
28 projection
28*b* retaining groove
28*c* recessed portion
55 torsion coil spring
55*a* one end
55*b* the other end
65 phase-advanced passage (hydraulic circuit)
66 phase-lagged passage (hydraulic circuit)
70 vane (vane portion)
90 positioning pin
110 timing gear (drive member)
R1 phase-advanced oil chamber
R2 phase-lagged oil chamber

The invention claimed is:

1. A valve opening/closing timing controlling apparatus, comprising:

a housing member rotatable together with a drive member for transmitting a drive force;

a rotor member rotatably assembled with the housing member, a vane portion of the rotor member forming, within said housing member, a phase-advanced oil chamber and a phase-lagged oil chamber, the rotor member being rotatable together with a cam shaft;

a torsion coil spring for urging the rotor member relative to the housing member in a phase advancing direction; and a hydraulic circuit for controlling feeding/discharging of work oil to or from said phase-advanced oil chamber or said phase-lagged oil chamber, wherein said torsion coil spring has one end thereof fixed to said housing member and the other end thereof fixed to a projection provided on said rotor member, wherein the other end of the torsion coil spring is retained in a retaining groove defined in said projection of the rotor member, and wherein the other end of the torsion coil spring is clamped between the retaining groove provided in the rotor member and a positioning pin inserted in the retaining groove for positioning the rotor member relative to the cam shaft.

2. A valve opening/closing timing controlling apparatus comprising:

a housing member rotatable together with a drive member;

a rotor member rotatably assembled with the housing member, a vane portion of the rotor member forming, within said housing member, a phase-advanced oil chamber and a phase-lagged oil chamber, the rotor member being rotatable together with a cam shaft;

a torsion coil spring for urging the rotor member relative to the housing member in a phase advancing direction; and a hydraulic circuit for controlling feeding/discharging of work oil to or from said phase-advanced oil chamber or said phase-lagged oil chamber, wherein said torsion coil spring has one end thereof fixed to said housing member and the other end thereof fixed to a concave recessed portion formed in a retaining groove formed in said rotor member.

3. The valve opening/closing timing controlling apparatus according to claim 2, wherein the other end of the torsion coil spring is clamped between the retaining groove and a positioning pin for positioning the rotor member relative to the cam shaft.

* * * * *